US009567188B2

(12) United States Patent
Huff et al.

(10) Patent No.: US 9,567,188 B2
(45) Date of Patent: Feb. 14, 2017

(54) ABSOLUTE POSITION DOOR ZONE DEVICE

(71) Applicant: ThyssenKrupp Elevator Corporation, Atlanta, GA (US)

(72) Inventors: Randolph Huff, Irvington, NY (US); Andrew DeLiso, Morristown, NJ (US)

(73) Assignee: ThyssenKrupp Elevator Corporation, Atlanta, GA (US)

( * ) Notice: Subject to any disclaimer, the term of this patent is extended or adjusted under 35 U.S.C. 154(b) by 458 days.

(21) Appl. No.: 14/174,021

(22) Filed: Feb. 6, 2014

(65) Prior Publication Data

US 2015/0217968 A1 Aug. 6, 2015

(51) Int. Cl.
*B66B 1/34* (2006.01)
*B66B 5/00* (2006.01)

(52) U.S. Cl.
CPC ..... *B66B 1/3492* (2013.01); *B66B 5/0025* (2013.01)

(58) Field of Classification Search
CPC ..... B66B 1/3492; B66B 5/0025
USPC ..... 187/247, 249, 382, 391, 393, 394, 187/282–284, 291
See application file for complete search history.

(56) References Cited

U.S. PATENT DOCUMENTS 3,955,649 A 5/1976 Takenoshita et al.
4,798,267 A 1/1989 Foster et al.
5,637,841 A * 6/1997 Dugan ..... B66B 1/30 187/291
5,747,755 A * 5/1998 Coste ..... B66B 1/3492 187/393
5,783,784 A * 7/1998 Durand ..... B66B 1/405 187/282
5,798,490 A * 8/1998 Vairio ..... B66B 1/50 187/283
5,831,227 A 11/1998 Finn et al.
(Continued)

FOREIGN PATENT DOCUMENTS

AU 591105 11/1989
CA 2728948 A1 2/2010
(Continued)

OTHER PUBLICATIONS

Canadian Office Action dated Feb. 22, 2016 for Application No. CA 2,878,566, 3 pgs.
(Continued)

*Primary Examiner* — Anthony Salata
(74) *Attorney, Agent, or Firm* — Frost Brown Todd LLC

(57) ABSTRACT

An elevator moves through a hoistway with one or more sensors positioned so that they pass by one or more targets that are in fixed positions relative to the hoistway. As they pass, an inductive current is generated, giving the elevator's control circuitry precise information as to the vertical position of the elevator car. The control system adjusts the raising and/or lowering of the elevator car based on that position information and any discrepancy between it and the supposed position at which the control system had believed the car was. Discrepancies are accumulated over time as an indication of cable stretch, and when the stretch exceeds a particular threshold, an alarm is raised for maintenance. The control system also defines a "door zone" around each landing where, based on the precise height measurement achieved herein, it is safe under the circumstances to open the doors of the car.

20 Claims, 6 Drawing Sheets

(56) References Cited

U.S. PATENT DOCUMENTS

| | | | | |
|---|---|---|---|---|
| 6,435,315 | B1 * | 8/2002 | Zaharia | B66B 1/3492 187/394 |
| 6,526,368 | B1 * | 2/2003 | Coste | B66B 1/40 187/284 |
| 6,750,658 | B2 | 6/2004 | Hofmann et al. | |
| 7,546,903 | B2 * | 6/2009 | Kattainen | B66B 1/3492 187/316 |
| 7,597,176 | B2 * | 10/2009 | Zaharia | B66B 1/3492 187/394 |
| 8,123,003 | B2 * | 2/2012 | Meri | B66B 1/3492 187/247 |
| 8,167,204 | B2 * | 5/2012 | Woodard | G01N 27/9046 235/435 |
| 8,276,716 | B2 | 10/2012 | Meri et al. | |
| 8,408,364 | B2 * | 4/2013 | Kangas | B66B 1/3492 187/247 |
| 8,430,327 | B2 * | 4/2013 | Woodard | H04Q 9/00 235/449 |

FOREIGN PATENT DOCUMENTS

| | | |
|---|---|---|
| CN | 101597001 | 12/2009 |
| CN | 202687676 | 1/2013 |
| WO | WO 2005/035418 | 4/2005 |
| WO | WO 2006/080633 | 8/2006 |
| WO | WO 2007/039750 | 4/2007 |
| WO | WO 2009/081476 | 7/2009 |
| WO | WO 2011/111096 | 9/2011 |
| WO | WO 2013/035368 | 3/2013 |
| WO | WO 2013/118317 | 8/2013 |

OTHER PUBLICATIONS

Abstract and English Machine Translation of Chinese Patent CN 101597001.

Abstract of Chinese Patent CN 202687676.

"BL-ARD Elevator Automatic Rescue Emergency Device", Shanghai Pariss Mechanical & Electrical Co., Ltd., Shanghai, China, 2013. (5 pages).

"Elevator Positioning", Inductive Proximity Sensors: Applications, Rockwell Automation, Allen-Bradley Mar. 2009 p. 2-19, (2 page.).

Marchesi, E., et al., "Sensor Systems in Modern High-rise Elevators", Sensors in Intelligent Buildings, Ed., O. Gassmann et al., 2001, pp. 261-291. (31 pages).

"Sensor Technology for Doors, Gates, and Elevators", Elevators: For absolute positioning, choose Pepper1+Fuchs, Printed in the U.S. 2008 by Pepper1+Fuchs, pamphlet p. 6. (5 pages).

* cited by examiner 104
114
lift
mechanism
106
Control
system
100
Target
110
102
116
Tag
car
118
RFID
interrogator
Target
112
108
110
Sensor
Target
110

ABSOLUTE POSITION DOOR ZONE DEVICE

FIELD

The present disclosure relates to elevators. More specifically, the present disclosure relates to devices for indicating or signaling operating conditions, in particular, the position of an elevator car.

BACKGROUND

In the field of elevators, it is desirable to control the position of an elevator car so that the floor of the passenger cabin is aligned with the floor of the building when passengers enter and exit the car. While there may be devices and methods that attempt to accomplish this, it is believed that no one prior to the inventor(s) has made or used an invention as described herein.

BRIEF DESCRIPTION OF THE DRAWINGS

It is believed that the present invention will be better understood from the following description of certain examples taken in conjunction with the accompanying drawings, in which like reference numerals identify like elements.

Figure 1:
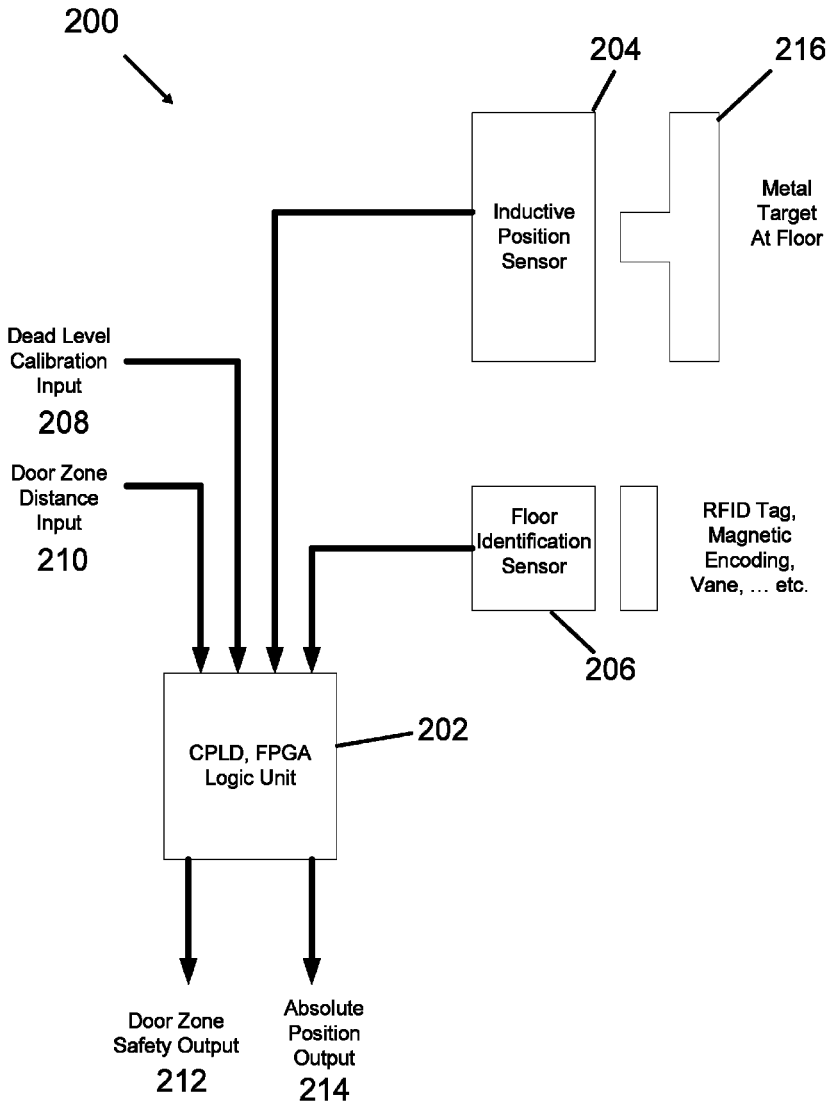
FIG. 1 is a schematic diagram of a portion of the control system used in some embodiments of the present system.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the descriptions serve to explain the principles of the invention; it being understood, however, that this invention is not limited to the precise arrangements shown.

DESCRIPTION

The following description and certain examples of the invention should not be used to limit the scope of the present invention. Other examples, features, aspects, embodiments, and advantages of the invention will become apparent to those skilled in the art from the following description. As will be realized, the invention is capable of other different and obvious aspects, all without departing from the invention. Accordingly, the drawings and descriptions should be regarded as illustrative in nature and not restrictive.

Generally, one embodiment of the present system is an elevator with a control system that manages its movement and position as a function of signals from inductive sensors configured to pass ferrous metal targets at or around one or more floors. The sensor includes one or more conductors situated in a plane along a spiral path. Alternative embodiments include multiple inductive sensors and/or multiple targets for redundancy and increased accuracy. Other features of certain embodiments include adjusting control of the elevator car to compensate for differences between the expected position (based on movement of the control system) and the actual sensed position, and such adjustments can be accumulated to raise an alarm when cable stretch requires maintenance. Further, adjustments to leveling can be made without the need to enter the hoistway and relocate or reposition sensors and/or targets. Yet another feature defines a "door zone" or "door zone length" defined based on sensor outputs and user input that can be varied or resized dynamically. Still yet, another feature allows the inductive sensing system to operate in an emergency rescue mode when the primary control system may be inoperable such that the elevator(s) can be accurately driven and positioned at floors based on the inductive sensing system so that would-be passengers at a given floor can be evacuated from the building.

For the purpose of clarity, certain terms used in the description above should be understood as having particular meanings. Thus, the phrase "based on" is used as an indication that something is determined at least in part by the thing that it is identified as being "based on." When something is completely determined by a thing, it will be described as being "based exclusively on" the thing. Also, the verb "determine" should be understood to refer to the act of generating, selecting or otherwise specifying something. For example, to obtain an output as the result of analysis would be an example of "determining" that output. As a second example, to choose a response from a list of possible actions would be a method of "determining" an action.

The phrase "door zone" in the context of an elevator car control system refers to a vertical position of the elevator car that is close enough to dead level with a landing for doors to be safely opened given the current control context (which might include, for example, normal operation, hospital operation, emergency operation, and firefighter control mode, to name just a few examples). The term "alarm" refers to a human-perceivable indication of a condition. For example, an alarm might be a smart phone notification, a sound, a light, a vibration or vibration pattern, an email message, or other indication as will occur to those skilled in the art.

The term "target" in the context of this disclosure refers to one half of a sensor/target pair that is activated by means of relative movement between the two. In some embodiments, the sensor/target pair matches a conductive coil with a rectangular plate of ferrous metal, one of them is called the sensor, and the other is called the target. In other embodiments, the sensor is a coil of conductive material, and the target is a structural piece of ferrous metal, such as a door frame, sill plate, or another steel part of a hoistway door (or even the door itself). In systems where the target is the hoistway door or another fixed component of the elevator like the sill plate or door frame, only the sensor position is adjustable for gross level adjustment if necessary. In systems where the target is a mounted plate of some kind, then both the target position and the sensor position can be adjustable for gross leveling adjustment if necessary. Fine level adjustment can be achieved by adjusting the door zone length as an input to the system such that these adjustments to achieve dead level can be attained without entering the hoistway and repositioning sensors and/or targets.

Figure 6:
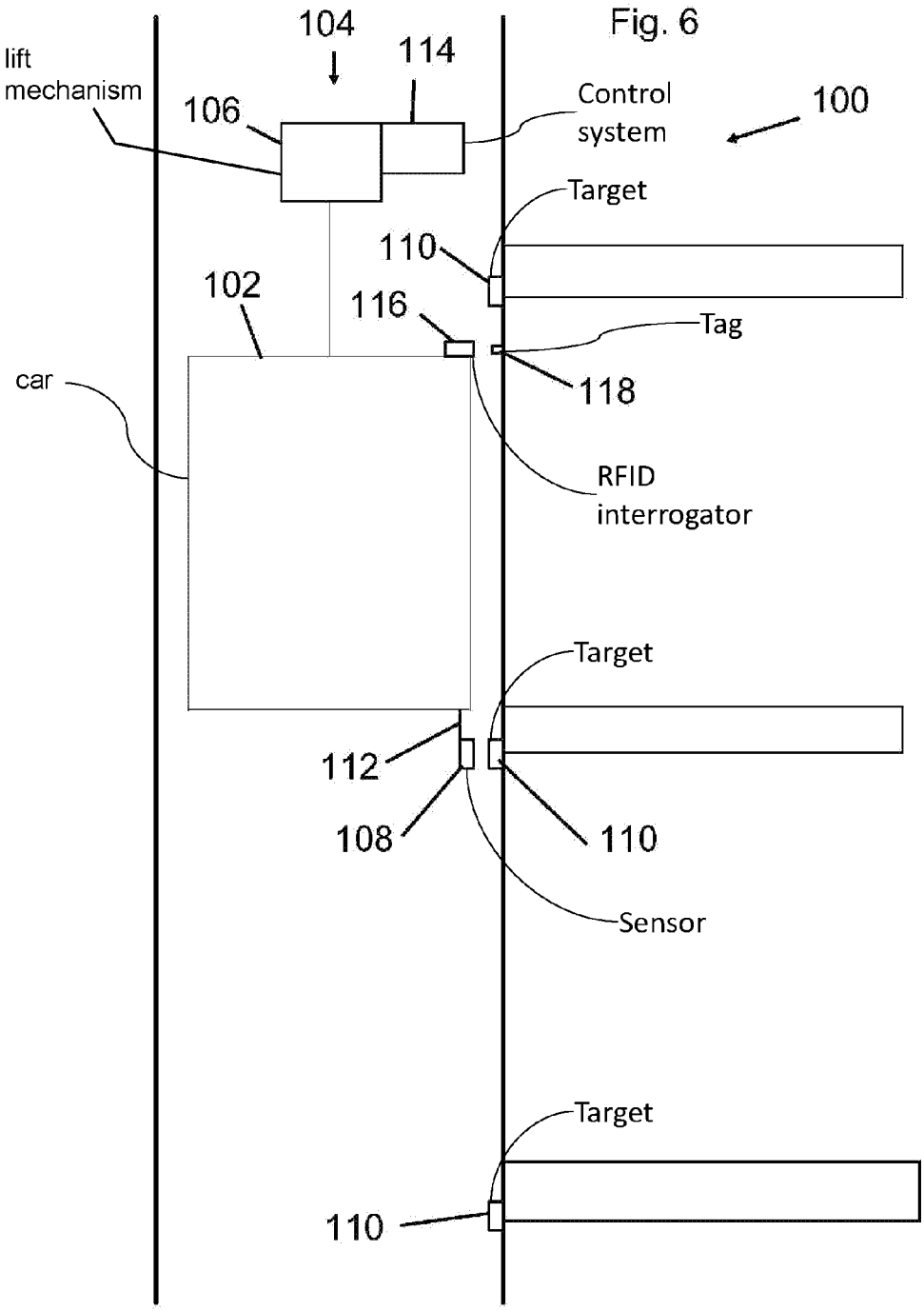
FIG. 6 is a side view of an elevator system that includes structures, components, and features common to many embodiments of the present system.

The overall context of some embodiments of the present system is illustrated in FIG. 6. System 100 includes car 102 that is moved up and down through hoistway 104 by a lift mechanism 106. Lift mechanism 106 can take any of the multitude of forms, as will occur to those skilled in the art. Nonlimiting examples include hydraulic lifts, traction lifts, belt lifts, and drum lifts. Traveling in connection with car 102 is sensor 108, which has a configuration adequate to inductively detect movement of sensor 108 past metal target 110.

In the illustrated embodiment, targets 110 are positioned in proximity with each floor served by car 102, but in other embodiments targets are placed at only a subset of the floors served by car 102. In still other embodiments, targets are placed in locations not associated at all with a floor served by car 102.

While FIG. 6 illustrates sensor 108 as being suspended from car 102 by strut 112, sensor 108 can alternatively be placed directly on the side of car 102, above car 102, or in any other location proximal to car 102 so that sensor 108 moves through hoistway 104 along with car 102. Those skilled in the art will understand there to be many options for how and where sensor 108 is placed in view of this disclosure.

In the present example, control system 114 is configured as the primary system for operating car 102 and positioning car 102 within hoistway 104 at landings of various floors without relying on information from sensor 108 and target 110. However, sensor 108 and target 110 are used as a way of confirming the position that control system 114 would abide by if operated completely independently from sensor 108 and target 110. And, actions and adjustments can be performed if warranted based on the confirmatory information from sensor 108 and target 110. Those skilled in the art will understand the available control systems 114 that act as a primary system for operating an elevator.

In the present example, control system 114 controls lift system 106, causing it to raise and lower car 102 based on a variety of inputs and conditions. One of those inputs in the illustrated embodiment is a signal from sensor 108 that indicates the position of sensor 108 relative to a target 110. Other inputs may include passenger controls inside car 102 (not shown), elevator call buttons on each floor adjacent to hoistway 104 (not shown), outputs from RFID interrogator 116 and tag 118 or other location identity reading apparatus. Control system 114 processes these inputs to generate outputs for controlling lift system 106 and for other purposes as is understood by those skilled in the art. In various embodiments, this processing occurs in a general-purpose processor in communication with the memory that is encoded with programming instructions executable by the processor to achieve the described functionality. In other embodiments, the processing is managed by an application-specific integrated circuit (ASIC), field-programmable gate array (FPGA), or other circuitry as will occur to those skilled in the art. This processing portion of control system 114 may be comprised of one or more components configured to operate as a single unit. When of a multi-component form, the processor may have one or more components located remotely relative to the others. One or more components of the processor may be of the electronic variety including digital circuitry, analog circuitry, or both. In some embodiments, the processor is of a conventional, integrated circuit microprocessor arrangement. In alternative embodiments, one or more reduced instruction set computer (RISC) processors, application-specific integrated circuits (ASICs), general-purpose microprocessors, programmable logic arrays, or other devices may be used alone or in combination as will occur to those skilled in the art.

Some of the logic circuitry in control system 114 for this exemplary embodiment is illustrated in FIG. 1 and will be discussed with continuing reference to FIG. 6. Control system 200 in this embodiment includes CPLD and/or FPGA logic unit 202, which takes input from inductive position sensor 204, floor identification sensor 206, dead-level calibration input 208, and door zone distance input 210. Logic unit 202 produces door zone safety output 212 and absolute position output 214 using logic that will occur to those skilled in the art in view of this disclosure.

Inductive position sensor 204 produces one or more outputs as a function of its movement relative to a ferrous metal target 216 positioned along the outside of hoistway 104 (see FIG. 6). In some embodiments, position sensor 204 produces an analog signal corresponding to the amount of overlap between position sensor 204 and a metal target 216, so that as car 102 moves along hoistway 104 and inductive position sensor 204 moves past metal target 216, the signal increases from a low value to a peak value, maintains that peak value as long as all of position sensor 204 is next to target 216, then falls again to the low value as the overlap between the components reduces to zero. Alternatively or additionally, position sensor 204 produces digital output that indicates the amount of overlap between position sensor 204 and target 216. The digital signal might simply be a binary value that has one value while position sensor 204 is overlapping target 216 to at least a threshold extent, and the other value at other times. Sometimes, however, the digital output of position sensor 204 has a greater number of possible levels (for example, 4, 8, 12, 16, 32, or other number of discrete values) selected as a function of the amount of overlap.

Floor identification sensor 206 also produces an output that is taken as an input to logic unit 202. Floor identification sensor 206 provides some means for logic unit 202 to identify the particular floor, landing, or other known position within hoistway 104 where car 102 is currently located. Any of a variety of technologies can be used for floor identification, such as RFID technology, magnetic encoding, a vane system, or other floor identification technique as will occur to those skilled in the art. In some versions, the identification of a specific floor is not required and the focus is instead on identification of a floor generally and ensuring that the elevator is level with the floor when stopping at that particular floor. In such instances the primary control system will have other means for determining absolute position of the elevator within the hoistway. The door zone positioning system 200 then operates as a confirmation that indeed the elevator is positioned properly, and in particular properly relative to the floor landing.

Door zone safety output 212 of logic unit 202 in this embodiment is a binary output used in the elevator system 100 to determine whether it is safe for the doors of car 102 to be opened because, for example, car 102 is or is not close enough to a dead-level position with respect to a landing. As those skilled in the art will understand, the signal may be overridden in certain circumstances, but is used as a logical input to other circuitry (not shown). In alternative embodiments, door zone safety output 212 is a multi-bit value that indicates whether car 102 is within the defined "door zone" for each of a plurality of situations—for example situations requiring car 102 to be within two inches of dead-level for instance compared to situations requiring car 102 to be within some other amount of dead-level.

In some versions, absolute position output 214 of logic unit 202 provides another input to the control logic of system 100, carrying relatively high-resolution data concerning the detected position of car 102 (determined based on the inputs to logic unit 202 like floor identification sensor 206 and others). In some embodiments, control system 114 maintains state information about the expected position of car 102 within hoistway 104 as control system 114 instructs lift mechanism 106 to raise and lower car 102. When control system 114 receives absolute position output 214, it compares this sensor-based value with the expected position state data and notes any corrections that need to be made to cause lift mechanism 106 to compensate for the difference. Such corrections in position can be made automatically by control system 114 or can be noted and manually input at that or a later time.

In some embodiments, control system 114 keeps track of these adjustments over time as a measurement of the amount of stretch being experienced by cables used in holding and moving car 102. In some of these embodiments, the accumulated stretch amount is reported on diagnostic devices. In some embodiments, when the accumulated stretch exceeds a certain value, and alarm is raised for maintenance of the elevator system 100 to replace the cable(s) or otherwise deal with the cable stretch.

In one exemplary mode, system 200 provides a way to vary or resize a door zone length dynamically, without the need to physically reposition targets and/or sensors. In such examples, door zone distance input 210 is an input to logic unit 202 that can be set as desired. For instance, in a normal office building environment the acceptable door zone length may be six inches. Thus so long as the floor of the elevator car is within six inches of the landing floor, also stated as within six inches of dead-level, the elevator car doors and hoistway doors will open such that passengers can enter and exit. In a hospital environment, the acceptable door zone length may be only two inches for instance. System 200 allows the door zone distance or length to be changed from six inches to two inches for example by changing the input to door zone distance input 210. Based on the known configuration and position of sensor and target pairs (e.g. 220, 230, 240, 250 as shown in FIGS. 2-5) relative to the hoistway and landing layout, and based on position sensor 204 producing output that indicates the amount of overlap between position sensor 204 and target 216 as described above, logic unit 202 is programmed to compare the door zone distance input 210 with the inductive position sensor 204 and target 216 information. The elevator doors can be controlled based on this comparison such that the door zone safety output 212 is enabled when the information or data from the sensor target pairs indicates that car 102 is within the door zone distance input 210 and disabled when not within the door zone distance input 210. When enabled, the car doors are permitted to open to accept entering or exiting passengers, and vice versa when disabled. In such a comparison, car 102 is within the door zone distance input 210 when the floor of car 102 is within the specified distance of the landing floor. In view of the teachings herein, other ways to enable a variable door zone distance will be apparent to those of ordinary skill in the art In one exemplary mode, system 200 provides a way to adjust leveling without the need to physically move, reposition, or relocate sensors or targets within the hoistway. In such examples, an initial setup has dead-level being when the target is in the middle of the sensor. Furthermore, in this example the door zone length is initially set to eight inches—thus four inches above and four inches below the middle of the sensor. For various reasons apparent to those skilled in the art, like rope stretch and others, what is dead-level initially may change. So in this example, after the initial setup and some time and rope stretch, without corrective action, the primary control system delivers the elevator slightly below the floor landing level. System 200 can detect this off level since when the elevator stops at the floor, the target is not in the middle of the sensor. System 200 can then create an alert or notification to prompt adjustment either automatically or manually.

Figure 3:
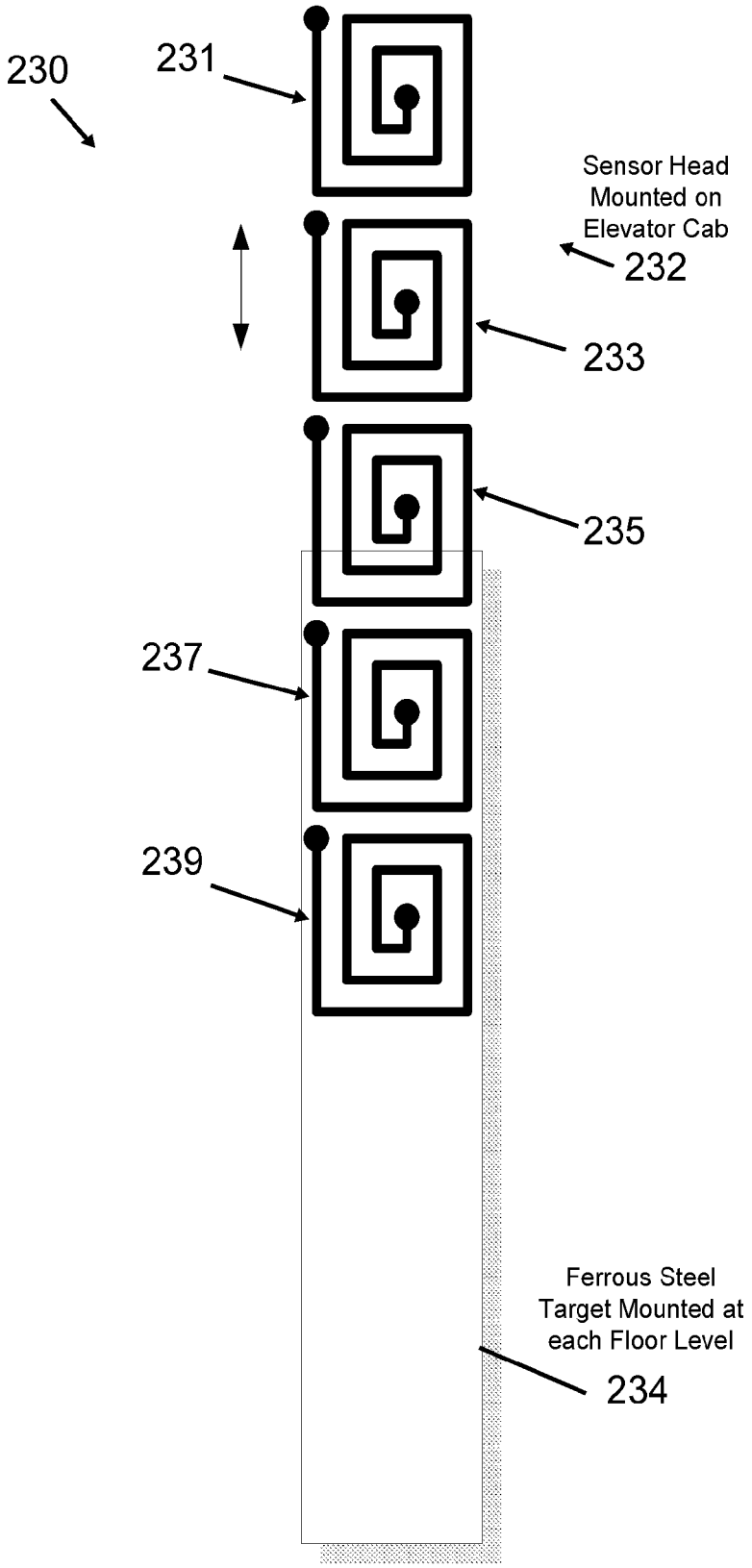
FIG. 3 is an elevational view of another sensor/target combination used in some embodiments of the present system.

Referring to FIG. 3 by way of example only and not limitation, sensor head 232 has five conductors 231, 233, 235, 237, 239 and target 234 that is sized to match the length of sensor head 232. Each conductor of sensor head 232 will produce the same signal reading when target 234 overlaps all conductors. In this configuration, the initial dead-level setting could be set such that when the primary control system delivers the elevator car dead-level with the floor, all conductors overlap target 234. After time and rope stretch, the primary control system delivers the elevator slightly below dead-level with the floor. System 200 detects this because when the elevator stops at the floor not all five conductors yield the same signal since not all five conductors have overlap with target 234.

In some systems without system 200, the elevator could be returned to dead-level by adjusting the position of certain other targets and sensors within the hoistway that work with the primary control system. In the systems with system 200, this can be accomplished by resizing the door zone length without entering the hoistway. For instance the door zone length can be adjusted by e.g. adjusting the top of the zone downward (DZD adjustment) and/or adjusting the bottom of the zone upward (DZU adjustment). Unless the DZD and DZU are adjusted by the same amount, when resizing door zone length, the center or middle of the resized door zone would move up or down relative to the previous center or middle of the prior sized door zone length. In the present example dead-level can be attained again without the need to enter the hoistway and move the physical position of targets and/or sensors. More specifically, door zone distance input 210 can be adjusted to resize (and in this case decrease) the door zone length for example to compensate the fact that dead-level is no longer in the middle of the sensor. The door zone distance input 210 could be a series of binary inputs or transferred to system 202 in a digital format. Once the elevator is returned to dead-level, the dead-level calibration input 208 is asserted to identify to system 202 the current location of dead-level.

Figure 2:
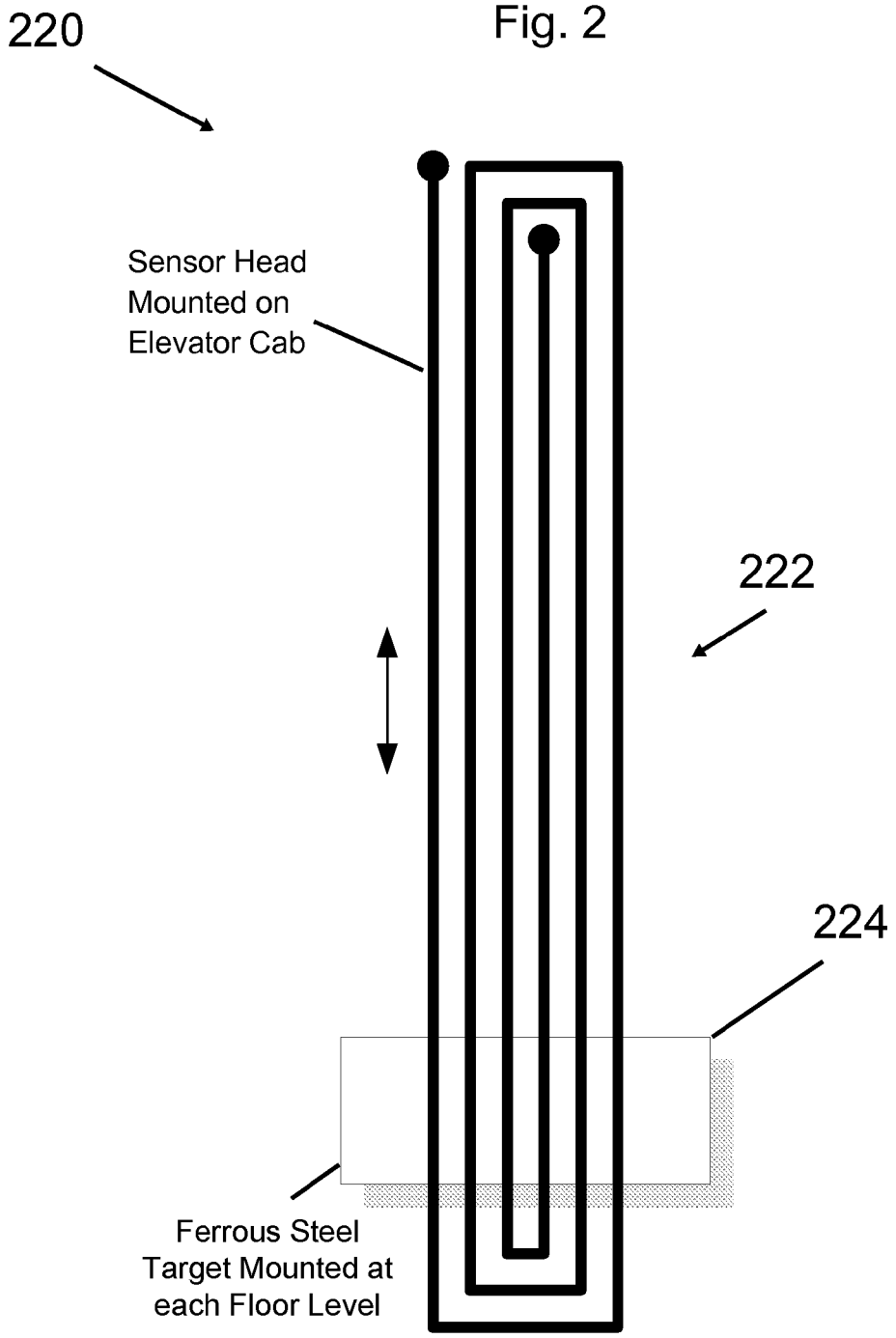
FIG. 2 is an elevational view of a sensor/target combination used in some embodiments of the present system.

FIG. 2 illustrates a combination sensor and target for use with various embodiments of the present system. Sensor/target pair 220 includes sensor coil 222 and target 224. Sensor coil 222 in this embodiment follows a spiral path, forming a generally rectangular overall shape oriented so that its vertical extent is greater than its horizontal extent. Target 224 in this embodiment is made of ferrous steel and mounted relative to each landing so that as sensor coil 222 passes by (in connection with car 102), sensor coil 222 moves near to target 224 and passes it in a direction perpendicular to the longest dimension of target 224 and along a path such that at least substantially all of coil 222 moves by in front of some portion of target 224.

FIG. 3 illustrates another combination sensor and target for use with various embodiments of the present system. Sensor/target pair 230 includes sensor head 232 and target 224. Sensor head 232 in this embodiment includes five conductors (231, 233, 235, 237, and 239, respectively), each following a spiral path and forming a generally square or rectangular overall shape. Together, conductors 231, 233, 235, 237, and 239 form sensor head 232 in this embodiment. Target 234 in this embodiment is made of a ferrous metal and mounted relative to each landing so that as sensor head 232 passes by (in connection with car 102), sensor head 232 moves near to target 234 and passes it in the direction parallel to the longest dimension of target 234 and along a path such that at least substantially all of sensor head 232 moves by in front of some portion of target 234. In this embodiment, logic unit 202 has more information about the exact location of car 102 because of the individual signals provided by conductors 231, 233, 235, 237, and 239.

Figure 4:
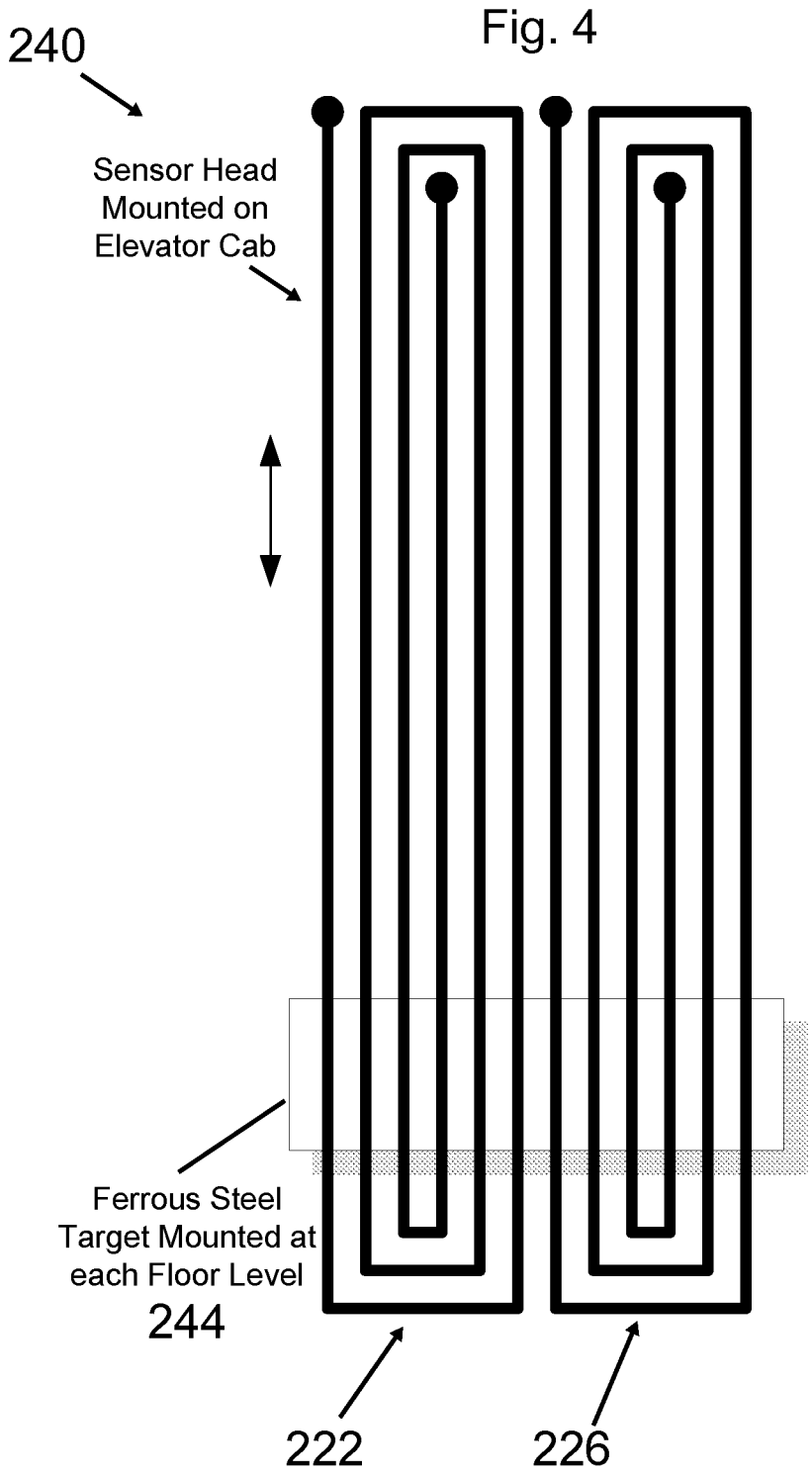
FIG. 4 is an elevational view of a third sensor/target combination used in some embodiments of the present system.

FIG. 4 illustrates yet another combination sensor and target for use with various embodiments of the present system. As with the sensor/target pairs discussed above, target 244 is mounted in hoistway 104 at a location corresponding to each floor level, at particular locations where detailed location information is desirable, and/or where such mounting is convenient. In this variation, however, a redundant pair of single coils 222 and 226 are mounted on or in association with car 102 at approximately the same height. Coils 222 and 226 feed individual control circuitry for purposes of redundancy, as will be understood by those skilled in the art. In this variation, both coils 222 and 226 pass by each target 244 at the same time, so a failure of one redundant system or the other can be detected as a difference between the received outputs of the associated sensor circuits.

Figure 5:
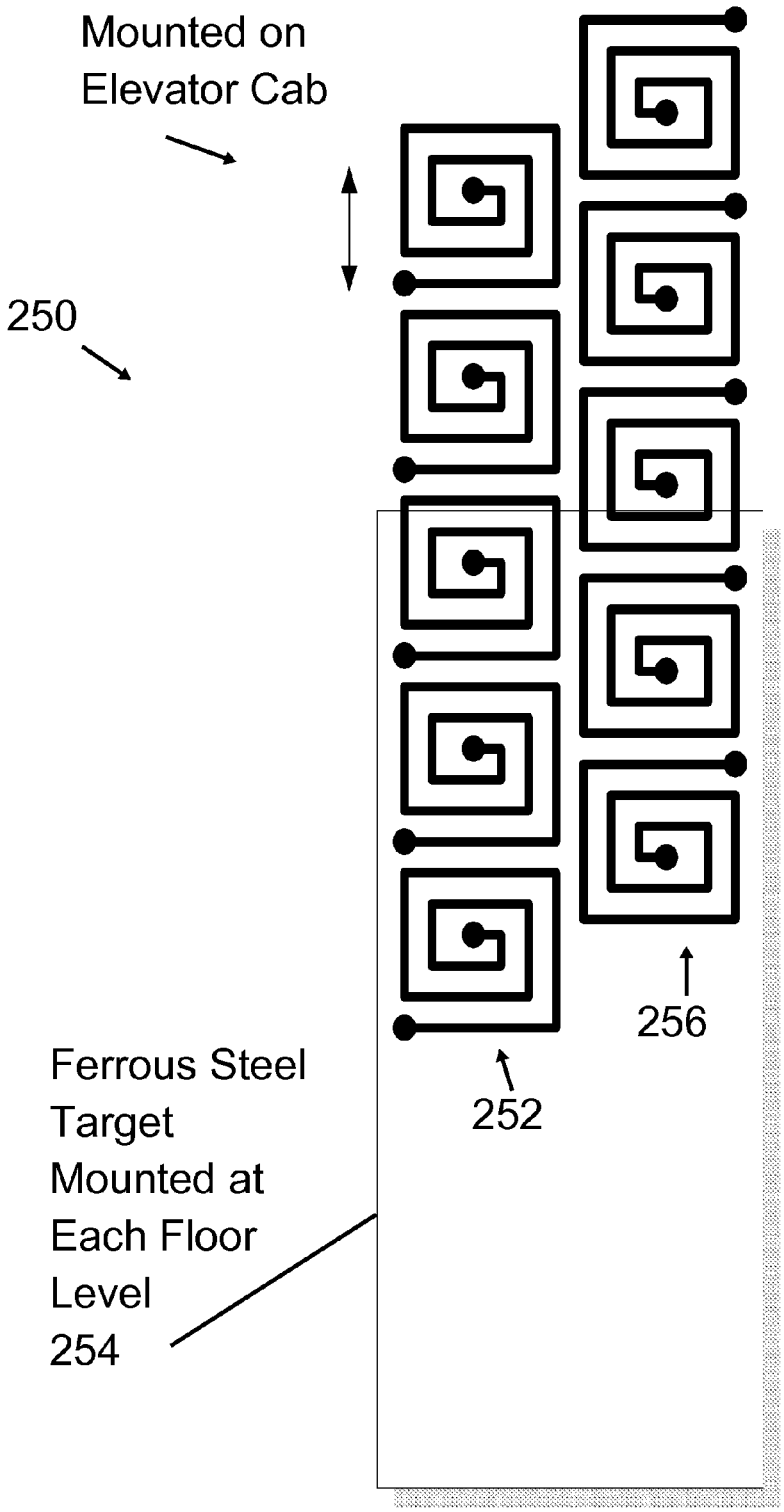
FIG. 5 is an elevational view of a fourth sensor/target combination used in some embodiments of the present system.

FIG. 5 illustrates still another combination sensor and target for use with various embodiments of the present system. Here, combination 250 includes redundant sensor sets 252 and 256, plus expanded target 254. Each sensor set 252 and 256 comprises a plurality of individual coils, and the sets are offset vertically so that no two individual coils are in the same position relative to target 254 at the same time. Signals generated by this configuration can thus be used to achieve greater precision in detection of location by leveraging the distinct vertical locations of each coil, and/or they can be processed to provide redundancy by interpolating the expected times of peak values between adjacent coils in one set versus the actual peak provided by the intervening coil in the other set. Such processing techniques are within the skill of those in the art in view of this disclosure.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometries, materials, dimensions, ratios, steps, and the like discussed above are illustrative and are not required. Accordingly, the scope of the present invention should be considered in terms of any claims that may be presented and is understood not to be limited to the details of structure and operation shown and described in the specification and drawings.

What is claimed is:

1. An elevator system, comprising:

a hoistway having two or more landings;

a metal target in the hoistway;

a car situated within the hoistway;

a lift mechanism that moves the car substantially vertically through the hoistway among the landings;

a control system that controls the lift mechanism; and a first inductive sensor that moves with the car, the first inductive sensor sending a first position signal to the control system based on the position of the first inductive sensor relative to the target;

wherein the control system:

maintains a state that indicates a supposed position of the car within the hoistway, starting with an initial state;

updates the state based on the first position signal; and controls the lift mechanism based at least in part on the state.

2. The elevator system of claim 1, wherein the first inductive sensor comprises one or more conductors, each configured along a spiral path.

3. The elevator system of claim 1, further comprising a set of inductive sensors that move with the car, wherein the first inductive sensor is one of the set of inductive sensors, each sensor of the set of inductive sensors sending a position signal to the control system based on the position of that inductive sensor relative to the target; and wherein the control system maintains the state based on the position signals from the set of inductive sensors.

4. The elevator system of claim 3, wherein each inductive sensor of the set of inductive sensors is positioned at a different height relative to the car, and in close proximity with another inductive sensor of the set of inductive sensors such that the set of inductive sensors forms a chain; and wherein the placement of the set of inductive sensors forms a vertical brick pattern having at least two vertical chains of inductive sensors.

5. The elevator system of claim 3, wherein each of the set of inductive sensors comprise one or more conductors, each conductor being configured along a spiral path.

6. The elevator system of claim 1, wherein the first inductive sensor comprises a plurality of conductors, each conductor is configured along a spiral path, and the plurality of conductors is positioned so that they do not pass the target at the same time as the car moves through the hoistway.

7. The elevator system of claim 1, wherein the control system produces an alarm if the updated state differs from the initial state by at least a predetermined amount.

8. The elevator system of claim 1, wherein the control system further defines a door zone comprising a relative distance between a floor of the car and a floor of a select one of the two or more landings, wherein the control system comprises a door zone safety output representing a multi-bit value indicating whether the car is within the defined door zone.

9. The elevator system of claim 1, wherein the car has a car door, and the control system defines a door zone as a function of the first position signal and the state;

determines an adjustment to the door zone that will result in the car being within a configured threshold of being dead level with a landing;

prompts a user via an electronic notification that provides a description of the adjustment to the door zone;

accepts user input from the user for adjustment of the door zone; and only opens the car door when the car is in the door zone.

10. A method of controlling an elevator, comprising the steps of:

moving an elevator car vertically through a hoistway among two or more landings, wherein:

a first inductive sensor moves with the car, a first target is in a substantially fixed position relative to a point in the hoistway, and as the car moves past the target; the first inductive sensor moves into and out of proximity to the first target;

receiving at a controller, a first position signal from the first inductive sensor based on the position of the first inductive sensor relative to the first target;

maintaining a state that indicates a supposed position of the car within the hoistway, starting with an initial state;

updating the state based on the first position signal; and controlling the moving of the car using the controller based at least in part on the state.

11. The method of claim 10, wherein the first inductive sensor comprises one or more conductors, each configured along a spiral path.

12. The method of claim 10, further comprising a set of inductive sensors moving with the car, wherein the first inductive sensor is one of the set of inductive sensors;

the controller receiving from each inductive sensor of the set of inductive sensors a position signal based on the position of that inductive sensor relative to the first target; and the controller maintaining the state based on the positions signals from the set of inductive sensors.

13. The method of claim 12, wherein each inductive sensor of the set of inductive sensors is:

positioned at a different height relative to the car, and in close proximity with another inductive sensor of the set of inductive sensors such that the set of inductive sensors forms a contiguous chain; and wherein the placement of the set of inductive sensors forms a vertical brick pattern having at least two vertical chains of inductive sensors.

14. The method of claim 12, wherein each of the set of inductive sensors comprise one or more conductors, each conductor being configured along a spiral path.

15. The method of claim 10, wherein the first inductive sensor comprises a plurality of conductors, each conductor is configured along a spiral path, and the plurality of conductors is positioned so that they do not pass the target at the same time as the car moves through the hoistway.

16. The method of claim 10, further comprising the control system producing an alarm if the updated state differs from the initial state by at least a predetermined amount.

17. The method of claim 10, further comprising:

defining a door zone comprising a relative distance between a floor of the car and a floor of a select one of the two or more landings; and determining whether one or more doors of the car may be opened based on a door zone safety output representing a multi-bit value indicating whether the car is within the defined door zone.

18. The method of claim 10, wherein the car has a car door, and further comprising the control system defining a door zone as a function of the first position signal and the state;

determining an adjustment to the door zone that will result in the car being within a configured threshold of being dead level with a landing;

prompting a user via an electronic notification that provides a description of the adjustment to the door zone;

accepting user input from the user for adjustment of the door zone; and opening the car door when the car is in the door zone.

19. The elevator system of claim 7, wherein:

the alarm comprises an electronic communication provided to a user;

the electronic communication comprises a description of the difference between the state and the first position signal, and a prompt for adjustment; and the state is updated based on the first position signal only after the user confirms the prompt for adjustment.

20. An elevator system, comprising:

a hoistway having two or more landings;

a metal target in the hoistway;

a car situated within the hoistway;

a lift mechanism that moves the car substantially vertically through the hoistway among the landings by moving a cable;

a control system that controls the lift mechanism; and a first inductive sensor that moves with the car, the first inductive sensor sending a first position signal to the control system based on the position of the first inductive sensor relative to the target;

wherein the control system is configured to:

maintain a state that indicates a supposed position of the car within the hoistway, starting with an initial state;

update the state based on the first position signal;

move the car to a floor based at least in part upon the state;

only allow opening of a door when the state indicates that the car is located within a configured door zone; and provide a notification when the difference between the state and the initial state indicates that the cable stretch has exceed a configured cable stretch limit.

* * * * *